US008237424B2

(12) United States Patent
Marty-Blavier et al.

(10) Patent No.: US 8,237,424 B2
(45) Date of Patent: Aug. 7, 2012

(54) REGULATED VOLTAGE SYSTEM AND METHOD OF PROTECTION THEREFOR

(75) Inventors: Arlette Marty-Blavier, Seysses (FR); Philippe Lance, Toulouse (FR); Stephan Ollitrault, Seysses (FR); Yean Ling Teo, Toulouse (FR)

(73) Assignee: Freescale Semiconductor, Inc., Austin, TX (US)

( * ) Notice: Subject to any disclaimer, the term of this patent is extended or adjusted under 35 U.S.C. 154(b) by 1005 days.

(21) Appl. No.: 12/161,521

(22) PCT Filed: Jan. 18, 2006

(86) PCT No.: PCT/EP2006/002848

§ 371 (c)(1),
(2), (4) Date: Jul. 18, 2008

(87) PCT Pub. No.: WO2007/082557

PCT Pub. Date: Jul. 26, 2007

(65) Prior Publication Data

US 2010/0283444 A1 Nov. 11, 2010

(51) Int. Cl.
*G05F 1/00* (2006.01)

(52) U.S. Cl. ..... 323/293

(58) Field of Classification Search ..... 323/293
See application file for complete search history.

(56) References Cited

U.S. PATENT DOCUMENTS

| | | | | |
|---|---|---|---|---|
| 3,636,448 | A | 1/1972 | Nihashi et al. | |
| 4,145,933 | A * | 3/1979 | Imig et al. | 73/770 |
| 4,433,390 | A | 2/1984 | Carp et al. | |
| 6,184,661 | B1 | 2/2001 | Becker et al. | |
| 6,288,881 | B1 | 9/2001 | Melvin et al. | |
| 6,404,607 | B1 | 6/2002 | Burgess et al. | |
| 6,427,183 | B1 * | 7/2002 | Seidenberg | 710/316 |
| 6,445,141 | B1 | 9/2002 | Kastner et al. | |
| 2004/0021576 | A1 | 2/2004 | Scott et al. | |
| 2009/0009919 | A1 * | 1/2009 | Taylor | 361/75 |

FOREIGN PATENT DOCUMENTS

| | | |
|---|---|---|
| JP | 55103471 | 8/1989 |
| JP | 02-264874 | 10/1990 |
| JP | 4181176 | 6/1992 |
| JP | 09173247 A * | 7/1997 |
| JP | 2000338159 | 12/2000 |

OTHER PUBLICATIONS

High temperature integrated voltage regulator system design Holter, B.; Fallet, T.; Circuits and Systems, 1997. Proceedings of the 40th Midwest Symposium on vol. 2, Aug. 3-6, 1997 pp. 1465-1468 vol. 2.

* cited by examiner

*Primary Examiner* — Jue Zhang

(57) ABSTRACT

A system comprises a voltage regulator operably coupled to an external component, a voltage regulator reset circuit and at least one functional element supplied with a voltage by the voltage regulator. The voltage regulator reset circuit is arranged to repetitively reset the voltage regulator upon disconnection of the external component.

18 Claims, 4 Drawing Sheets

FIG. 1 - Prior art
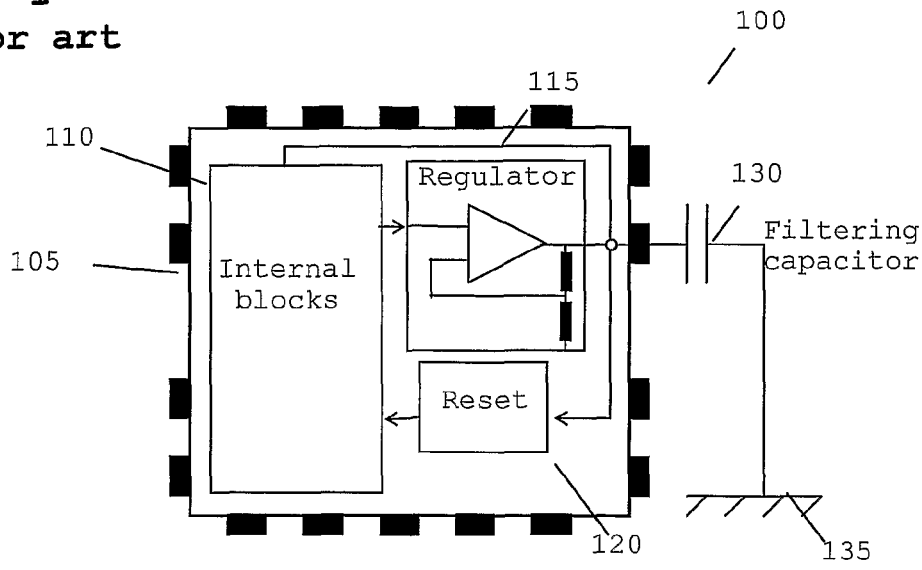
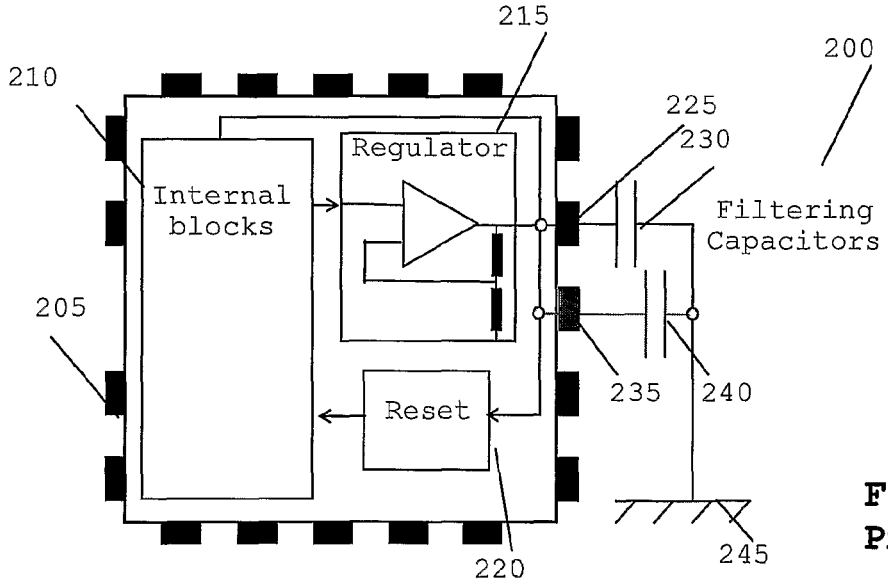
FIG. 2 - Prior art

REGULATED VOLTAGE SYSTEM AND METHOD OF PROTECTION THEREFOR

FIELD OF THE INVENTION

The present invention relates to a regulated voltage system.

The invention is applicable to, but not limited to, protecting the voltage regulator from undesired disconnection from an external capacitor coupled to the voltage regulator.

BACKGROUND OF THE INVENTION

In the field of analog and mixed integrated circuits (ICs), it is known that the ICs often use, or are operably coupled to, external components.

The analog/mixed ICs are often used in safety applications. Clearly, system behaviour in safety applications must be carefully controlled, such that system operation is reliable and not jeopardised. For example, it is known that the accidental disconnection of external components, such as external filtering capacitors, may jeopardise the operation and functionality of the IC, and therefore the system.

One example is a system that utilises a voltage regulator IC, which is typically coupled to one or more external capacitors for filtering purposes. FIG. 1 illustrates a known system having a voltage regulator offering no protection, should an external capacitor be disconnected. In FIG. 1, the known system 100 comprises an analog or mixed integrated circuit 105 having an internal functional element 110. The internal functional element 110 is supplied with a voltage from voltage regulator 115; which is operably coupled to a reset circuit 120. An external filtering capacitor 130 is operably coupled between the voltage regulator 115 on the analog or mixed integrated circuit 105 and ground 135 to provide ac coupling via IC pin 125 to the voltage regulator 115.

The filtering capacitor 130 is typically of the order of μF, and hence is of a significant size. The size of the filtering capacitor 130 effectively means that it cannot be integrated on the analog or mixed integrated circuit 105, and has to be coupled to the analog or mixed integrated circuit 105 externally.

When this external capacitor 130 is disconnected, the voltage regulator 115 is still trying to regulate without the external capacitor. Hence, behaviour of the voltage regulator 115, e.g. its output voltage, is degraded; yet the voltage regulator 115 is still able to maintain enough voltage to avoid reaching a reset threshold of the reset circuit 120. The consequence is that a degraded system is running without any detection of the disconnection or, indeed, any safe, predictable state of the voltage regulator, say following a reset operation. Consequently, internal system functions, circuits or elements supplied by the voltage regulator 115 may also exhibit non-predictable behaviour, which is undesirable.

A common way to solve this problem is to introduce redundancy into the system. FIG. 2 illustrates a known system 200 having a voltage regulator 215 and employing a redundant capacitor protection arrangement for a case where an external capacitor may be disconnected.

In FIG. 2, the known system 200 comprises an analog or mixed integrated circuit 205 having an internal functional element 210. The internal functional element 210 is supplied with a voltage from voltage regulator 215, which is operably coupled to a reset circuit 220. A first external filtering capacitor 230 is operably coupled between the voltage regulator 215 on the analog or mixed integrated circuit 205 and ground 245, via pin 225, to provide ac coupling via IC pin 225 (not shown in FIG. 2) to the voltage regulator 215.

In order to provide protection to the system, a second external filtering capacitor 240 is operably coupled in parallel to the first external filtering capacitor 230 between the voltage regulator 215 on the analog or mixed integrated circuit 205 and ground 245, via pin 235. In this manner, the system employs redundancy in coupling two external capacitors to two de-coupling pins.

If either of the first or second external filtering capacitors is inadvertently disconnected, the system is still protected with the remaining connected external capacitor. In this case, the voltage regulator 215 continues to work normally. The remaining capacitor stabilizes the voltage regulator 215 and filters any noise. Each capacitor value is calculated so that the system behaviour and performance is acceptable in normal operation and if the other capacitor is disconnected for whatever reason.

However, this solution leads to an IC package with a higher pin count, component count and increased size due to an additional extra component, than is actually needed by the system, and is therefore inefficient and unnecessarily costly.

Thus, a need exists for an improved protection mechanism for a voltage regulator and associated integrated circuit system, in case of disconnection of a coupled-to external component, such as a filtering capacitor.

STATEMENT OF INVENTION

In accordance with aspects of the present invention, there is provided a protection system and method of operation to reduce the effect of capacitor disconnection, as defined in the appended Claims.

BRIEF DESCRIPTION OF THE DRAWINGS

FIG. 1 illustrates a known system having a voltage regulator and no protection in a case where an external capacitor is disconnected; and FIG. 2 illustrates a known system having a voltage regulator and employing a redundant capacitor protection arrangement for a case where an external capacitor is disconnected.

Figure 3:
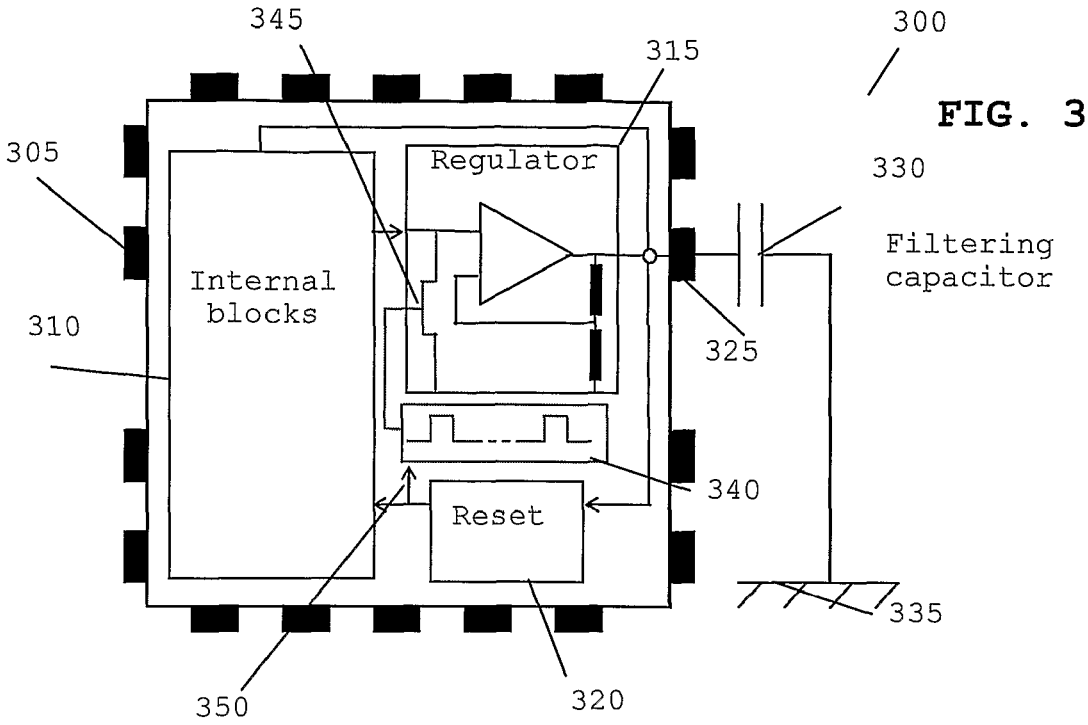
Figure 4:
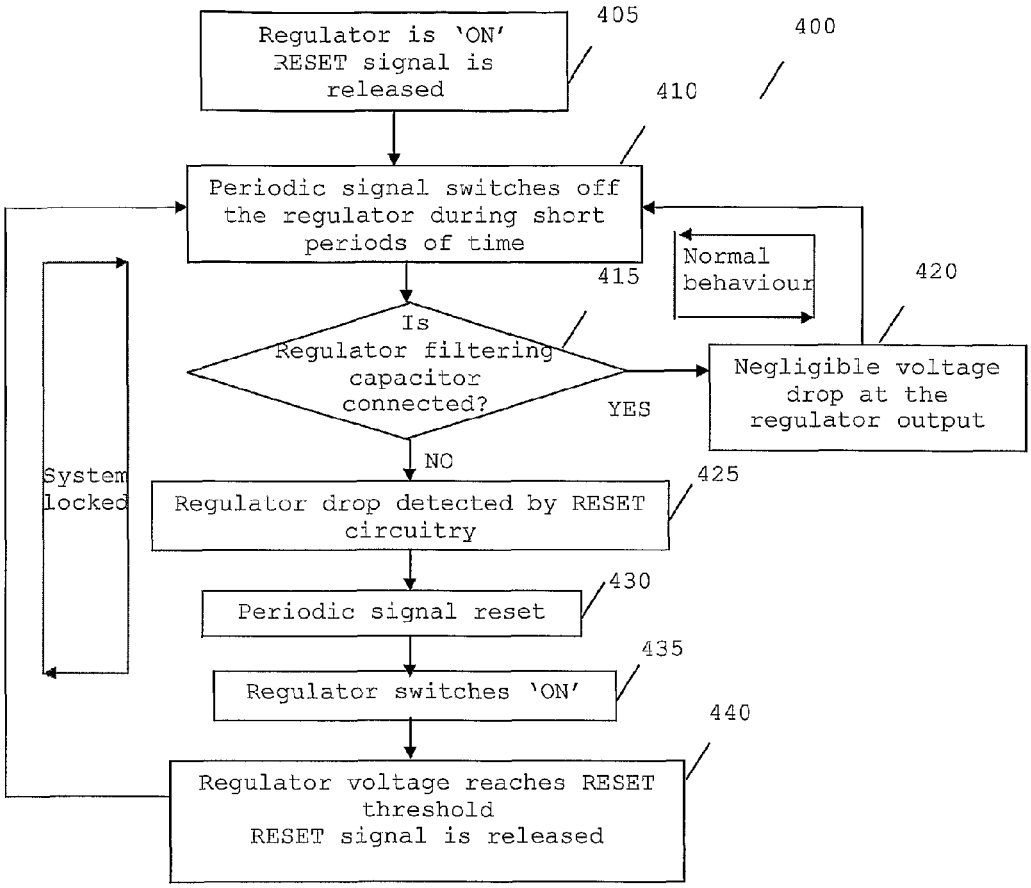
Figure 5:
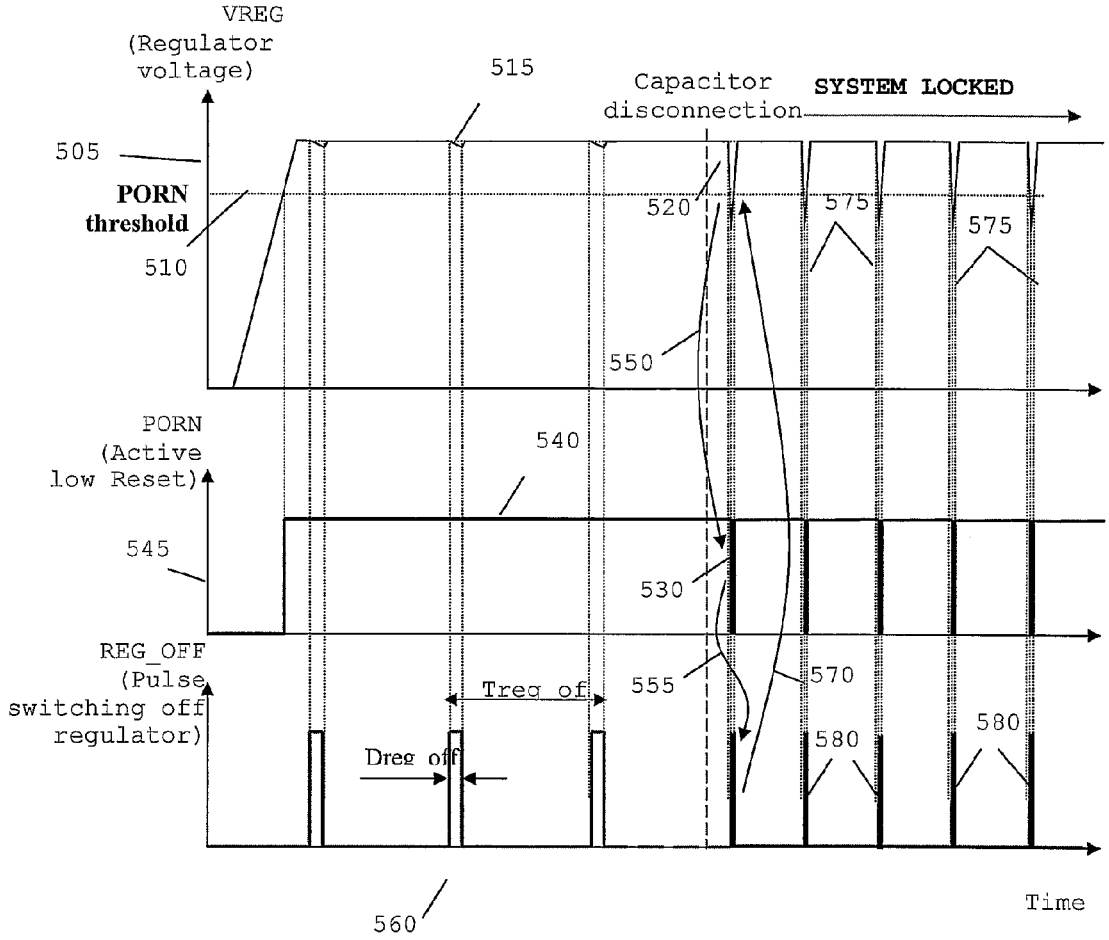

Exemplary embodiments of the present invention will now be described, by way of example only, with reference to the accompanying drawings, in which:

FIG. 3 illustrates a system having a voltage regulator and employing a protection arrangement in accordance with one embodiment of the present invention;

FIG. 4 illustrates a flowchart of a system lock-up sequence in accordance with one embodiment of the present invention; and FIG. 5 illustrates a voltage regulator, reset and periodic pulse waveforms in accordance with one embodiment of the present invention.

DESCRIPTION OF PREFERRED EMBODIMENTS

In summary, a fully integrated system and method for detecting a disconnection of an external capacitor and instigating a system lock condition in response thereto, is described.

Referring now to FIG. 3, a system 300 comprises an analog or mixed integrated circuit 305 having at least one internal functional element 310, with only one functional element shown for clarity purposes only. The internal functional element 310 is supplied with a voltage from voltage regulator 315, which is operably coupled to a reset circuit 320. An external filtering capacitor 330 is operably coupled between the voltage regulator 315 on the analog or mixed integrated circuit 305 and ground 335, via pin 325, to provide ac coupling via IC pin 325 to the voltage regulator 315.

In accordance with one embodiment of the present invention, a regulator switch 345 and pulse generator 340 are operably coupled to the voltage regulator 315 and reset circuit 320. The pulse generator 340 is arranged to provide periodic voltage pulses that are arranged to intermittently, and temporarily, switch off the voltage regulator 315.

In one embodiment of the present invention, the pulse generator 340 responds to whether the external capacitor is connected. If the external capacitor 330 is connected, a negligible voltage drop will occur at the voltage regulator output. If the external capacitor 330 is disconnected, the voltage drop from the voltage regulator is significant.

The voltage drop (or lack thereof) below a threshold is detected by reset circuit 320. The reset circuit 320 then applies a reset pulse via path 350 to internal functional element(s) including the pulse generator 340, in order to initiate a reset of the system. In this regard, a signal output from the pulse generator 340 is forced back to '0', which causes the voltage regulator 315 to be tuned 'ON' again via regulator switch 345. The voltage regulator output rises back to its regulated voltage. In this manner, the active low reset signal is released, i.e. re-set 'high', and the process repeats until the external capacitor is re-connected.

Thus, when the regulated output voltage 325 drops below a threshold value, a system reset is activated via the reset circuit 320, which resets the pulse generator 340. The pulse generator re-setting causes the voltage regulator operation to return to a normal output voltage, and the process repeats. If the external capacitor 330 is subsequently and correctly connected, the system 300 returns to normal operation, with the reset circuit 320 failing to provide a reset signal to the pulse generator 340 and internal functional element 310. In this normal mode of operation, the pulse generator returns to its 'periodic' pulse generation mode.

However, if the external capacitor 330 is still disconnected, an infinite loop of regulator shut down, reset, regulator restart, voltage increase, regulator shut down, etc. is performed. This effectively means that the system 300 is in a locked mode.

Referring now to FIG. 4, a flowchart 400 illustrates a system lock-up sequence, in accordance with one embodiment of the present invention. The flowchart commences with the voltage regulator being in an 'ON' condition. A voltage regulator 'reset' signal is released, by the 'reset' function, in step 405. With the 'reset' signal released, signals are generated by the pulse generator and applied to the voltage regulator to intermittently (e.g. periodically) and temporarily switch the voltage regulator 'OFF' and immediately back 'ON', as shown in step 410.

A determination is then made as to whether the external filtering capacitor is connected to the system/analog or mixed IC, as in step 415. If the external filtering capacitor is connected to the system/analog or mixed IC, in step 415, there is negligible voltage drop at the voltage regulator output in step 420. Thus, the active low 'reset' circuit remains inactivated and the flowchart loops back to step 415 in normal system behaviour.

However, if it is determined in step 415 that the filtering capacitor is disconnected for any reason, the system reverts to operating in a system-locked mode. Here, the voltage regulator drops below a threshold and is detected by the 'reset' circuit, which then initiates a 'reset' signal that is applied to the pulse generator, as shown in step 425. Consequently, the pulse generator pulse switches back to '0', in step 430, and the Regulator switches back 'ON', as shown in step 435. The regulator output voltage rises until it reaches a reset threshold, in step 440, thereby releasing the reset signal. The process then enters an infinite loop condition, and loops back to step 410, completing the 'system-lock' loop.

Referring now to FIG. 5, a voltage regulator waveform 505, a reset waveform 540 and a periodic pulse waveform 560 are illustrated in accordance with one embodiment of the present invention.

The voltage regulator waveform 505 illustrates the regulator voltage versus time. Once the voltage regulator is turned 'ON', it remains in an 'ON' state until the external capacitor is disconnected 520. Such a disconnection is shown as a rapid voltage drop. Temporary resetting of the voltage regulator output voltage 515, due to the periodic switching 'OFF' operation of the pulse generator, is shown.

A second waveform 540 illustrates an active low reset operation. A third waveform 560 illustrates a repetitive and periodic switching 'OFF' pulse applied to the voltage regulator. Thus, the regulator output voltage 515 temporarily drops. If the external capacitor is disconnected, the output voltage 515 of the voltage regulator drops 520 below the 'PORN' threshold 510. This drop in regulator output voltage generates a falling edge on the active low reset signal 530 (thereby resetting internal elements), which forces the pulse generator switch 'OFF' signal 560 back to '0'. This causes the voltage regulator to be turned 'ON' again and the output voltage 515 rises back to the regulated value.

Notably, when the regulated output voltage crosses the PORN threshold 510 (in an upwards direction), the active low reset signal 540 is set high again, i.e. 'reset' is released.

Thus, the effect of the voltage regulator 'REG_OFF' pulse 580, when back to '0', increases the regulated voltage above the threshold and the cycle repeats, ad infinitum. Thus, the system enters a 'system locked' state. The aforementioned mechanism is applicable to any voltage regulator circuit that is able to tolerate a noise level of a few mV, be it an analog or mixed analog/digital or digital circuit.

A skilled artisan will appreciate that in other applications, alternative functions/circuits/devices and/or other process steps or waveform/pulse configurations may be used.

The present invention is described in terms of a voltage regulator, operably coupled to an external capacitor that ensures correct operation of the voltage regulator. However, it will be appreciated by a skilled artisan that the inventive concept herein described may be embodied in any type of circuit or device where a regulated voltage is operably coupled to an external component whose disconnection affects the operation of the circuit or device.

The present invention has been described with reference to 'resetting the voltage regulator', which is envisaged to encompass, in one embodiment, a 'switching 'OFF' of the voltage regulator'. In this regard, the 'Reg_OFF' periodic signal switches the voltage regulator 'OFF', and the corresponding voltage drop generates a reset signal, which resets the internal elements and resets the Reg_OFF pulse. This leads to switching 'ON' the voltage regulator again.

In one embodiment, the 'resetting the voltage regulator', encompasses a 'switching 'OFF' of the voltage regulator' for a short period of time. By switching 'OFF' the regulator for a short period of time, the detection of the 'short' switch 'OFF' period can be detected in a number of ways, including, but not limited to:

(i) Activation of the PORN (ii) Activation of any other signal to notify of a disconnection (e.g. without switching 'OFF' the regulator);

(iii) Detecting AC noise induced by the short period of switch 'OFF', say in the case of a capacitive disconnection.

It will be appreciated that any suitable distribution of functionality between different functional units or voltage regulators, may be used without detracting from the inventive concept herein described. Hence, references to specific functional devices or elements are only to be seen as references to suitable means for providing the described functionality, rather than indicative of a strict logical or physical structure or organization.

Aspects of the invention may be implemented in any suitable form including hardware, software, firmware or any combination of these. The elements and components of an embodiment of the invention may be physically, functionally and logically implemented in any suitable way. Indeed, the functionality may be implemented in a single unit or IC, in a plurality of units or ICs or as part of other functional units.

It will be understood that the improved mechanism and method of operation therefor, as described above, aims to provide at least one or more of the following advantages:

(i) No additional pin and/or component is required to facilitate system protection;

(ii) The mechanism is easily adaptable to classic voltage regulator topologies, thereby providing easy reuse and rapid design integration;

(iii) The mechanism is cost effective, since it is capable of being fully integrated and easy to implement;

(iv) The mechanism provides a safe behaviour of the system in a case where an external component, such as a filtering capacitor, is disconnected; and (v) The solution can be readily applied to an embedded system.

In particular, it is envisaged that the aforementioned inventive concept can be applied by a semiconductor manufacturer to any integrated circuit comprising a voltage regulator that is operably coupled to an external capacitor, for example those of the Freescale™ analog/mixed device family. It is further envisaged that, for example, a semiconductor manufacturer may employ the inventive concept in a design of a stand-alone device or application-specific integrated circuit (ASIC) and/or any other sub-system element.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term 'comprising' does not exclude the presence of other elements or steps.

Furthermore, although individual features may be included in different claims, these may possibly be advantageously combined, and the inclusion in different claims does not imply that a combination of features is not feasible and/or advantageous. Also, the inclusion of a feature in one category of claims does not imply a limitation to this category, but rather indicates that the feature is equally applicable to other claim categories, as appropriate.

Furthermore, the order of features in the claims does not imply any specific order in which the features must be performed and in particular the order of individual steps in a method claim does not imply that the steps must be performed in this order. Rather, the steps may be performed in any suitable order. In addition, singular references do not exclude a plurality. Thus, references to "a", "an", "first", "second" etc. do not preclude a plurality.

Thus, an improved system comprising a voltage regulator circuit and method of protection therefor have been described, wherein the aforementioned disadvantages with prior art arrangements have been substantially alleviated.

The invention claimed is:

1. A system comprising:

a voltage regulator operably coupled to an external component;

a voltage regulator reset circuit; and at least one functional element supplied with a voltage by the voltage regulator;

wherein the voltage regulator reset circuit is arranged to repetitively reset the voltage regulator upon disconnection of the external component, wherein the external component is a capacitor.

2. The system of claim 1, wherein the external capacitor is a filtering capacitor.

3. The system of claim 1 further comprising a pulse generator operably coupled to the voltage regulator and arranged to provide repetitive pulses to the voltage regulator to repetitively switch off the voltage regulator.

4. The system of claim 3 wherein the repetitive pulses are triggered by a voltage drop occurring at an output of the voltage regulator.

5. The system of claim 4 wherein the repetitive pulses are triggered when the voltage drop at an output of the voltage regulator drops below a threshold.

6. The system of claim 4 wherein the reset circuit is operably coupled to the pulse generator and the voltage drop generates a trigger reset signal in the reset circuit to be applied to the pulse generator.

7. The system of claim 2, further comprising a pulse generator operably coupled to the voltage regulator and arranged to provide repetitive pulses to the voltage regulator to repetitively switch off the voltage regulator.

8. The system of claim 1, wherein the system is integrated onto an analog or mixed analog/digital integrated circuit.

9. The system of claim 5, wherein the reset circuit is operably coupled to the pulse generator and the voltage drop generates a trigger reset signal in the reset circuit to be applied to the pulse generator.

10. A method for protecting a system comprising a voltage regulator coupled to a reset circuit, an external component and at least one functional element, the method comprising the steps of:

supplying a voltage by the voltage regulator to the functional element;

determining whether the external component is connected to the voltage regulator, wherein the external component is a capacitor; and repetitively resetting the voltage regulator by the reset circuit in response to disconnection of the external component from the voltage regulator.

11. The method of claim 10, wherein the step of determining comprises detecting a voltage drop at a voltage regulator output.

12. The method of claim 11, wherein the step of repetitively resetting the voltage regulator occurs in response to detecting a voltage drop below a threshold at a voltage regulator output.

13. The method of claim 10, wherein the step of repetitively resetting the voltage regulator comprises resetting the voltage regulator in a system lock-up operation.

14. The method of claim 10, wherein the step of repetitively resetting the voltage regulator comprises applying a voltage regulator reset signal to the voltage regulator thereby intermittently switching the voltage regulator 'OFF'.

15. The method of claim 14 wherein applying a voltage regulator reset signal comprises initiating a periodic voltage regulator reset signal thereby periodically switching the voltage regulator 'OFF'.

16. The method of claim 11, wherein the step of repetitively resetting the voltage regulator comprises resetting the voltage regulator in a system lock-up operation.

17. The method of claim 11, wherein the step of repetitively resetting the voltage regulator comprises applying a voltage regulator reset signal to the voltage regulator thereby intermittently switching the voltage regulator 'OFF'.

18. The method of claim 12, wherein the step of repetitively resetting the voltage regulator comprises applying a voltage regulator reset signal to the voltage regulator thereby intermittently switching the voltage regulator 'OFF'.

* * * * *